US006263179B1

(12) United States Patent
Lin

(10) Patent No.: US 6,263,179 B1
(45) Date of Patent: Jul. 17, 2001

(54) PARTICLE FLOW ENHANCING AGITATOR ARTICLE

(75) Inventor: Pinyen Lin, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/429,656

(22) Filed: Oct. 29, 1999

(51) Int. Cl.[7] ..... G03G 15/08
(52) U.S. Cl. ..... 399/254; 399/281
(58) Field of Search ..... 399/254, 256, 399/272, 281

(56) References Cited

U.S. PATENT DOCUMENTS 4,926,217 * 5/1990 Bares ..... 399/254
4,947,211 * 8/1990 Ono et al. ..... 399/281 X
5,075,728 * 12/1991 Kobayashi et al. ..... 399/281
5,124,752 * 6/1992 Kanno et al. ..... 399/256 X
5,305,064 4/1994 Trott et al. .
5,572,299 11/1996 Kato et al. ..... 399/256
5,784,671 7/1998 Damki et al. ..... 399/110
5,797,075 * 8/1998 Saito et al. ..... 399/281 X

* cited by examiner

*Primary Examiner*—William J. Royer
(74) *Attorney, Agent, or Firm*—John L. Haack

(57) ABSTRACT

An article including: a rigid rod with ends adapted to engage a developer housing and a drive train for continuously rotating the rod; and a resilient flexible sheet attached to the rigid rod on at least one edge of the sheet.

19 Claims, 4 Drawing Sheets

PARTICLE FLOW ENHANCING AGITATOR ARTICLE

CROSS REFERENCE TO COPENDING APPLICATIONS AND RELATED PATENTS

Attention is directed to commonly owned and assigned U.S. Pat. No. 5,784,671.

Attention is directed to commonly assigned copending application U.S. Ser. No. 09/318,945, filed May 26, 1999, entitled "AUTOMATIC CAMMING OF A DEVELOPER MODULE" which discloses a mechanism for use in a printing machine having a cover for covering a portion of the printing machine. The mechanism is operably associated with the cover and with the portion of the printing machine. The mechanism is adapted so as to move the portion of the printing machine as the cover is opened.

The disclosures of each of the above mentioned patents and copending applications are incorporated herein by reference in their entirety. The appropriate components and processes of these patents may be selected for the apparatus and processes of the present invention in embodiments thereof.

BACKGROUND OF THE INVENTION

This invention relates generally to a xerographic development apparatus incorporating an improved agitation article which apparatus controllably and accurately conveys particulate imaging materials from a sump reservoir to an imaging member. More specifically the invention concerns a single component xerographic development apparatus and an agitation article therein which apparatus improves the flowability and the supply of imaging particulate materials, such as magnetic and non-magnetic toner particles, to a photoreceptor. The apparatus and article improve the overall imaging performance and imaging quality of printing machines that incorporate the improved hardware. The improved development apparatus solves the so-called "white banding" image defect problem.

The article, apparatus, and imaging method of the present invention solves important particulate transport and development problems and provides various advantages including: improved developer agitation; improved developer circulation; improved developer charging and developability; reduced or eliminated white banding image defects; increased development apparatus reliability; reduced downtime for blockage or leakage problems associated with the prior art development apparatus; preventing localized developer and toner agglomeration in the area near the donor roll; providing improved developer circulation between the sump and the surface of the donor roll; and improving developer charging stability.

One-component and two-component developer systems utilize toner that can be difficult to flow and charge controllably. This is particularly true of the toner used in one component systems. The toner tends to cake and bridge within the sump or within the developer housing. Also, this tendency to cake and bridge may cause soft blocked toner cakes to form within the developer housing which cakes can distort the charging of the toner and produce image defects in the printed images.

In addition, the developer on the donor roll often suffers severe high mechanical stress under low toner throughput condition. This is because the developer on the donor roll cannot readily get off the donor roll and circulate well with the developer in the housing. This stressed developer has poor powder flow, poor charging stability, and lower charge. Consequently, the solid area density of the prints decreases and the background grayness increases.

These and other problems are solved with the article, development apparatus, and imaging method of the present invention.

PRIOR ART

In U.S. Pat. No. 5,305,064, to Trott et al., issued Apr. 19, 1994, there is disclosed an electrophotographic apparatus in which toner particles are moved from the toner hopper or dispenser cartridge to the developer housing and onto the donor roller in a single component development system for use in color reprographic systems. A rotating holey tube toner agitator is modified to incorporate structure or grooves on the outer peripheral surface. Further, by placing a shrouded toner dispense auger inside the holey tube, the development system architecture stays compact and improved toner powder pushing through the pre-load of toner on the donor roller results, thereby insuring delivery of fresh toner evenly across the length of the developer housing. With more efficient pre-load, agitator rotational speed and bias can be reduced, leading to less toner effluents emanating from the developer housing without adversely affecting the cycle to cycle donor roller toner reload.

In U.S. Pat. No. 5,572,299, to Kato et al., issued Nov. 5, 1996, there is disclosed a developing device which has a vessel for holding a two-component developer composed of a toner component and a magnetic component. A magnetic roller is rotatably provided within the vessel to bring the developer to a developing zone for a development of an electrostatic latent image. An agitator also is provided within the vessel for agitating and circulating the developer to cause a triboelectrification between the toner component and the magnetic component and a uniform distribution of the toner component in the magnetic component. The agitator is arranged to present a uniform density mass of the developer to the magnetic roller for ensuring an even development of the latent image.

In the aforementioned commonly owned application U.S. Pat. No. 5,784,671, issued Mar. 30, 1999, to Damji et al., there is disclosed an electrostatographic process cartridge detachably mountable into a cavity defined by mated modules forming parts of an electrostatographic reproduction machine. The cartridge includes an elongate housing having walls defining a front end of the process cartridge, a rear end thereof, and a process chamber; a rotatable endless photoreceptive member having a closed loop path with the process chamber, and an image bearing surface for holding a formed toner image, and being mounted with the process chamber and towards the rear end for contacting a toner image receiving sheet moving along a machine sheet path for toner image transfer.

The disclosures of the aforementioned patents are incorporated herein by reference in their entirety.

SUMMARY OF THE INVENTION

Embodiments of the present invention, include:

An article comprising:

- a rigid member, such as a rod or tube, with a first end and a second end where the ends are adapted to engage a developer housing and a drive train for continuously rotating the rod; and
- a resilient flexible sheet attached to the rigid rod; and An apparatus comprising:

a housing adapted for the conveyance of particulate developer materials from a sump to an imaging member;

a conveyor within the housing adapted for advancing the developer materials from the sump to a donor roll;

a donor roll situated at least partially within the housing adapted for advancing a charged and metered layer of the developer material on the donor roll from the donor roll to the imaging member;

a charge metering blade which flexibly contacts the surface of the donor roll and which blade is adapted to charge and meter a thin layer of developer material onto the donor roll; and an agitator article including, for example, a rigid rod with a resilient flexible sheet appended thereto and situated within the housing and adapted for further advancing developer materials from the auger to the donor roll and charge metering members; and An imaging process comprising:

developing a latent image on a photoconductive surface with a toner material with the foregoing development apparatus;

transferring the resulting developed image from the photoconductive surface to an image receiver; and fixing the resulting transferred image to the image receiver.

These and other aspects are achieved, in embodiments, of the present invention as described and illustrated herein.

DETAILED DESCRIPTION OF THE INVENTION

Figure 1:
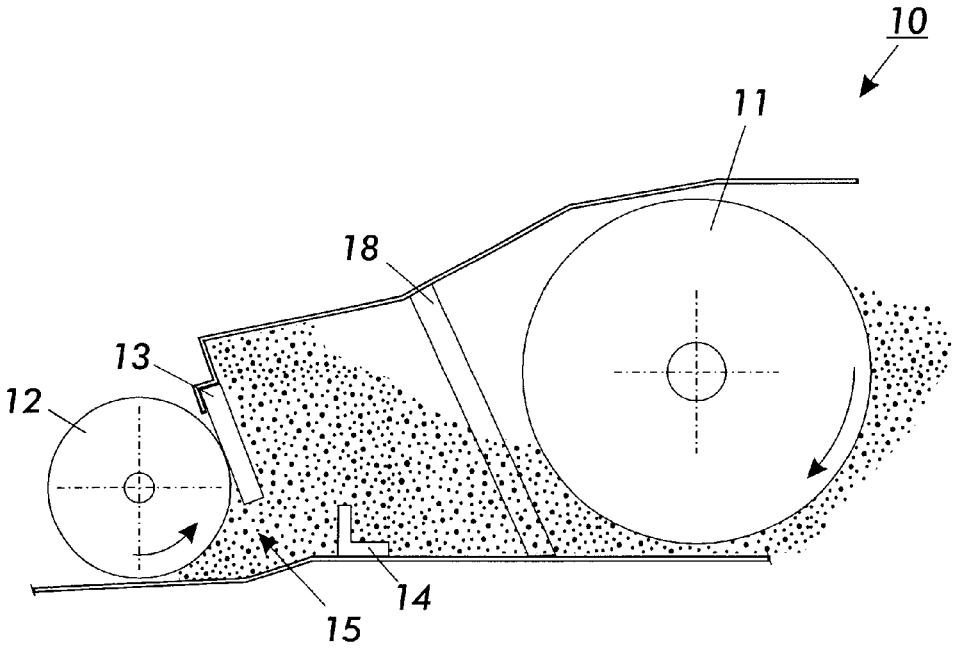
FIG. 1 PRIOR ART
FIG. 1 illustrates a cross-sectional view of a development apparatus of the prior art.

The present invention in embodiments provides:

An article comprising:

a rigid member, such as a rod or tube, with a first end and a second end wherein the ends are adapted to engage a developer housing and a drive train for continuously rotating the rod; and a resilient flexible sheet attached to the rigid rod on at least one edge of the sheet, where, for example, the rotated article imparts excellent agitation and flow of particulate materials within and through the developer housing.

The resilient flexible sheet can be attached to the surface of the rod at, for example, one of the sheet edges forming a "flap" type structure. In another embodiment the resilient flexible sheet can be attached to the rod at, for example, two edges of the sheet edges forming an endless closed flexible loop surface about the rod. Reference, for example, FIGS. 3 and 4, respectively.

The attachment or fastening of the sheet to the rod can be accomplished in a variety of ways, such as using any suitable adhesive to bond the sheet to the surface of the rod. Alternatively, variations or combination of fastening or mechanical attachment methods can be used, for example, using an adhesive to attach the sheet to the surface of the rod within one or more vias cut into the rod surface to accommodate one or both ends of the sheet. Where a seam or irregular surface results from the attachment of the sheet to the rod, a filler material may be used to minimized or eliminate any spaces or gaps where particulate materials might accumulate, for example, momentarily or permanently, and be trapped. The sheet can be attached to the outer surface of the rod, for example, when an adhesive is selected, at from about 1 to about 90 degrees of rod circumference. Alternatively or additionally, the sheet can be attached to the rod in at least one slotted vias within the surface of the rod.

The rigid rod can be constructed of any suitably rigid and durable material, for example, cast metals, forged metals, powdered metals, molded metals, mixed metal alloys, resins, ceramers, ceramics, fiber composites, and the like materials, and mixtures and combinations thereof.

The sheet can be constructed of any suitably flexibly resilient material, including, for example, polyesters, polyvinylacetate, polyethylene, polypropylene, styrene copolymers, fluoropolymers, and the like polymeric and copolymeric materials, two-ply and multi-ply structures thereof, and combination and mixtures thereof. A particularly preferred sheet material is, for example, MYLAR®.

In an exemplary embodiment, when a steel rod with a diameter of about 2 to about 5 millimeters and a length of about 30 centimeters to span the entire width of the developer housing is selected as the rigid rod, the sheet can have, for example, a width of from about 1 to about 30 millimeters, preferably from about 5 to about 15 millimeters, a length of from 5 about to about 50 centimeters, preferably from about 30 centimeters to match the span of the rod across the developer housing, and a nominal thickness of from about 100 to about 1,000 microns, and preferably from about 300 to about 600 microns. The elongation percentage of the sheet material can be, for example, from about 100 percent to about 1,200 percent. The glass transition temperature of the sheet material can be, for example, from about −80° C. to about 50° C. The density of the sheet material can be, for example, from about 0.7 g/cm$^3$ to about 1.8 g/Cm$^3$.

The rotation of the article within the developer housing agitates and disturbs stagnated developer materials. The rotation of the article within a developer housing agitates developer materials and urges the egress of developer materials smoothly through the developer housing. The rotation of the article including the rod and the attached flexible sheet, as a "flap" (open) or "looped" (closed) structure, within the developer housing disturbs developer materials that are, for example, trapped or stalled within the developer housing in so-called "dead zones" and smoothly urges the egress of developer materials through the developer housing.

The rotation of the article within the developer housing can be readily accomplished by adapting existing gears and drive mechanisms that drive the donor roll and the sump agitator of the aforementioned prior art developer apparatus. When the donor roll is rotated for toner development, the agitation rod, alternatively referred to as a scraper-disturber, can be rotated to create disturbance that enhances toner flowability and toner supply uniformity, and simultaneously reduce localized accumulation of toner particles with low developability at or near the nip formed by the contact of the donor roll with the charge-metering blade.

In embodiments the present invention provides an apparatus, for example, for use in xerographic development, comprising:

a housing adapted for the conveyance of particulate developer materials from a sump to an imaging member;

a conveyor within the housing adapted for advancing the developer materials from the sump to a donor roll;

a donor roll situated at least partially within the housing adapted for advancing a charged and metered layer of the developer material on the roll from the donor roll to the imaging member;

a charge metering blade which contacts the surface of the donor roll and which blade is adapted to charge and meter a thin layer of developer material onto the donor roll; and an agitator article, including for example, a rigid rod or rigid tubular member, with a resilient flexible sheet appended thereto situated within the housing and adapted for further advancing developer materials from the auger to the donor roll and charge metering members.

The developer material can be any known developer, for example, toner particles, such as magnetic or non-magnetic toner particles, preferably toner particles for single component development applications comprising a resin, a colorant, and optional performance additives, such as, for release, flow, and charge properties. The relative rotational speed ratio of the agitator to the donor roll can be, for example, from about 0.2 to about 1.5. The relative rotational direction of the agitator and the donor roll can be the same direction or opposite direction.

The donor roll can rotate, for example, at from about 30 millimeters per second to about 150 millimeters per second. The rotation of the donor roll can be either clock-wise or counter clock-wise relative to the auger rotation depending, for example, upon the location of the charge metering blade. The charge metering blade is preferably in resilient and flexible contact with and adjacent to the donor roll, and the blade is preferably located between the sump and the donor roll substantially as shown, for example in FIG. 2 described below.

The throughput of developer material from the sump to the donor roll and then to the imaging member can be, for example, from about 50 to about 2,000 milligrams per minute. Thus the apparatus can be used in xerographic printing and copying processes for producing, for example, from about 1 to about 50 single color prints or impressions per minute.

In embodiments there can be an electrical or charge bias on: the charge metering blade, the auger, the agitator, and or the donor roll to the photoreceptor. In a preferred embodiment neither the auger nor the agitator article are biased. If desired these components and the aforementioned components can be individually or collectively, partially or completely, grounded to assist in regulating the charge properties of the developer materials being conveyed and developed.

The rotation of the agitator article within the developer housing causes the article to repeatedly contact portions of the interior walls of the developer housing and the charge metering blade componentry in the immediate vicinity of the donor roll. There results, for example, the disturbance of adherent developer materials, the urging of adherent or stagnant developer materials into the main stream or bulk of the active developer materials in the developer housing, and a leveling of the main stream of developer materials residing and passing through the developer housing between the auger and the donor roll. Compare, for example, the relative developer levels in FIGS. 1 and 2.

In embodiments the present invention provides an imaging process comprising:

developing a latent image on a photoconductive surface with a toner material with the aforementioned development apparatus;

transferring the resulting developed image from the photoconductive surface to an image receiver; and optionally fixing the resulting transferred image to the image receiver.

In embodiments, the article, the apparatus, and imaging processes of the present invention produce printed images which are free of the aforementioned white banding image defects. Although not wanting to be limited by theory, white banding imaging defects are believed to be caused by localized in-situ generated sub-functional toner particles. Sub-functional toner particles are, for example, toner particles with less surface additive, toner particles with strongly adhered surface additives, toner particles with reduced flowability, or agglomerated toner particles. Once sub-functional toner particles are formed near the nip between the charge metering blade and the donor roll, the particles have a reduced tendency to "jump" from the donor roll to the photoreceptor in the development zone. The reduced jumping ability of the toner particles produces a persistent radial band of retained toner on the donor roll which ultimately produces the white-band image defect in the resulting printed images.

The agitator or scraper-disturber article of the present invention can also remove or promote desirable removal of developer from the donor roll, for example, as the rotating flexible sheet structure or loop structure repeatedly and intermittently contacts the donor roll. Continuous removal of developer from the donor roll ensures that fresh developer in the sump consistently gets to and onto the donor roll. The residence time of the developer on the operating donor roll is reduced to a minimum. The developer is thereby precluded from achieving a stressed condition, such as reduced toner flow pockets and isolated high or low toner charge levels, for example, during low throughput rate conditions. The overall reduced developer residence time can translate into higher net developer charge levels for the developer, and thereby provide improved development characteristics, particularly in transfers from the donor roll to the photoreceptor.

Referring to the Figures, FIG. 1 shows a cross-sectional view of a development apparatus(10) of the prior art including housing, sump auger(11) shown by directional arrow rotating in a clock-wise direction adapted for driving toner from the sump into the housing chamber and thereafter to donor roll(12), a charge metering blade(13), and deflecting "L"-bracket(14). The prior art developer housing configuration is comparatively disadvantaged because toner particles can accumulate in the housing chamber, especially near the charge metering blade in nip area(15). Optional rib (18) can provide additional support to the housing while still affording sufficient flexibility to the charge metering blade (13).

Figure 2:
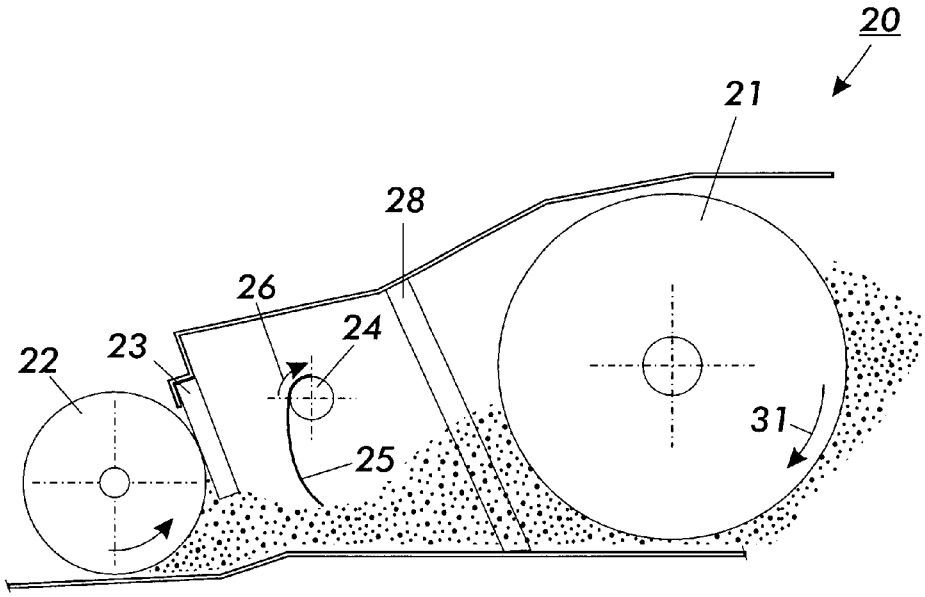
FIG. 2 illustrates a cross-sectional view of a development apparatus including an agitator article of the present invention.

FIG. 2 illustrates a cross-sectional view of a development apparatus of the present invention including housing(20), sump auger(21) shown by directional arrow(31) rotating in a clock-wise direction adapted for driving toner from the sump into the housing chamber and thereafter to donor roll(22), a charge metering blade(23), a rigid rod(24) with attached flexible sheet(25) shown rotating in a clock-wise direction by directional arrow(26). The present invention is advantaged over the prior art developer housing configuration since toner particles cannot easily accumulate or stagnate in the housing chamber, especially near the charge metering blade because of the superior agitation and toner disturbance action afforded by the agitator article formed from rigid rod(24) and attached flexible sheet(25). Optional rib (28) can provide additional support to the housing while affording sufficient flexibility to the supporting structure for the charge metering blade(23). It is readily appreciated by one of ordinary skill in the art that rigid rod(24) can alternatively be any suitable equivalent structure, such as a rigid hollow tube of comparable outer dimensions to the rod, and which structure can be readily adapted to fasten the flexible sheet(25) thereto. It is also readily appreciated that the present invention contemplates that the agitator article includes alternative equivalent structures to the flexible sheet(25), for example, as shown in FIG. 5 and described herein.

Figure 3:
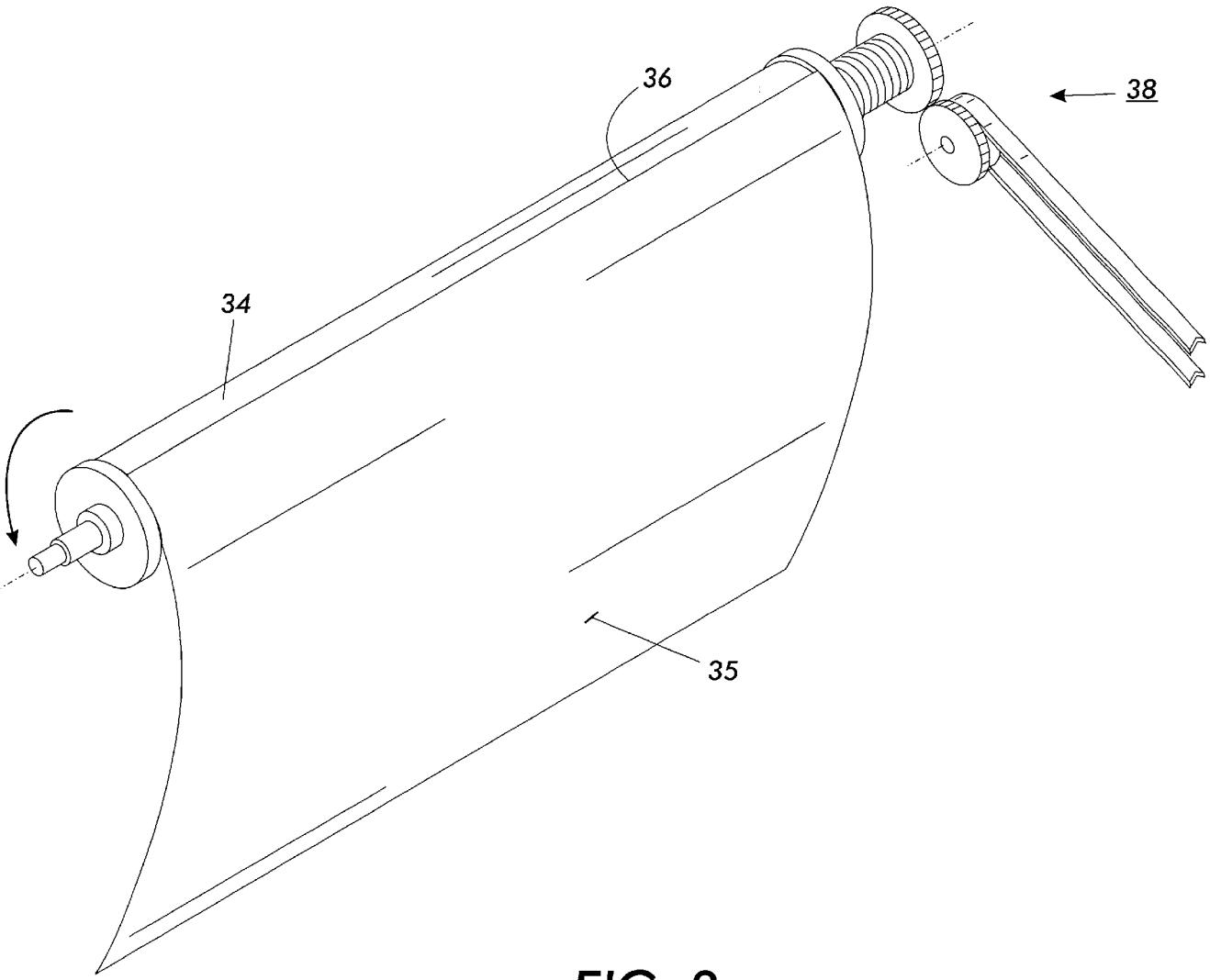
FIG. 3 illustrates a perspective view of an exemplary agitator article in embodiments of the present invention.

FIG. 3 shows a perspective view of an exemplary agitator article including a rigid rod(34), and flexible sheet(35) attached at a point or a plurality of points substantially across the entire length span of the rigid rod within the developer housing. The attachment of the sheet (35) to rod(34) can be accomplished, for example, with a suitable adhesive or other suitable fastening methods, such as press fitting the sheet (35) within a seam or race(36) on the rod (34). It is also readily appreciated by one of ordinary skill in the art that rod (34) includes or can be modified to include equivalent alternative structures such as a roller, drum, mandrel, and the like configurations. The agitator rod can be rotated by a variety of drive mechanisms, for example, a chain or belt drive linkage(38) which may be connected to, or independent of, the rotation of other developer housing componentry, such as, the donor roll or the sump auger.

Figure 4:
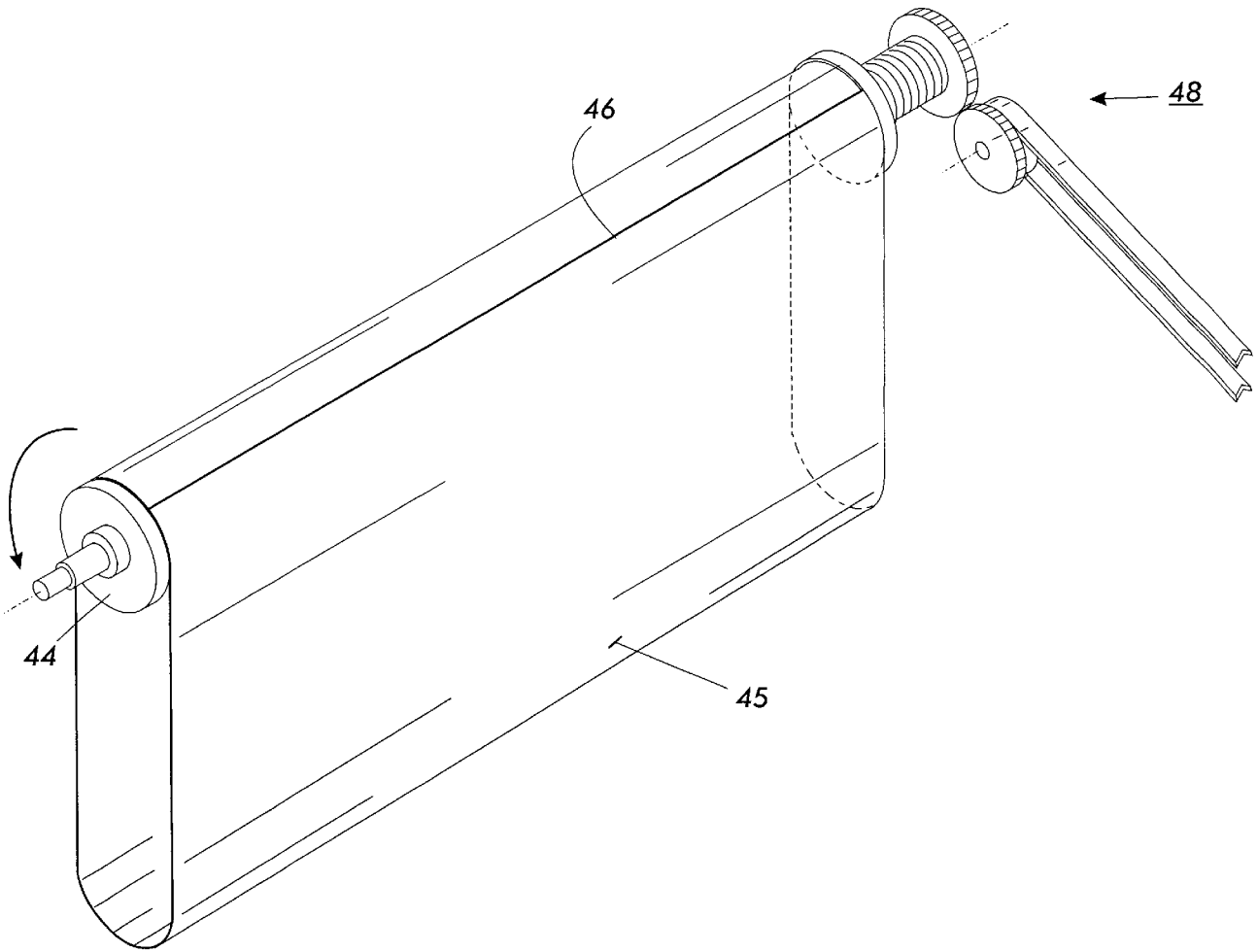
FIG. 4 illustrates a perspective view of an exemplary "looped" agitator article in embodiments of the present invention.

FIG. 4 shows a perspective view of another embodiment of an exemplary agitator article including a rigid rod(44), and flexible sheet(45) attached at a point or a plurality of points, and preferably and substantially across the entire span of the rigid rod within the developer housing. The sheet can, for example, be attached to the rod by two of its ends to form a flexible closed loop structure. The closed loop structure can provide certain operational advantages, and manufacturing, assembly, and replacement advantages. The attachment of the sheet (45) to rod(44) can be accomplished, for example, with a suitable adhesive or other suitable fastening methods, such as press fitting the sheet (45) ends within a seam or race(46) on the rod (44). Also contemplated are structural alternatives for rod (44) such as a roller, drum, mandrel, and the like configurations. Again, the agitator rod can be rotated by a variety of drive mechanisms, for example, a chain or belt drive linkage(48) which may be connected to, or independent of, the rotation of other developer housing componentry, such as, the donor roll or the sump auger.

Figure 5:
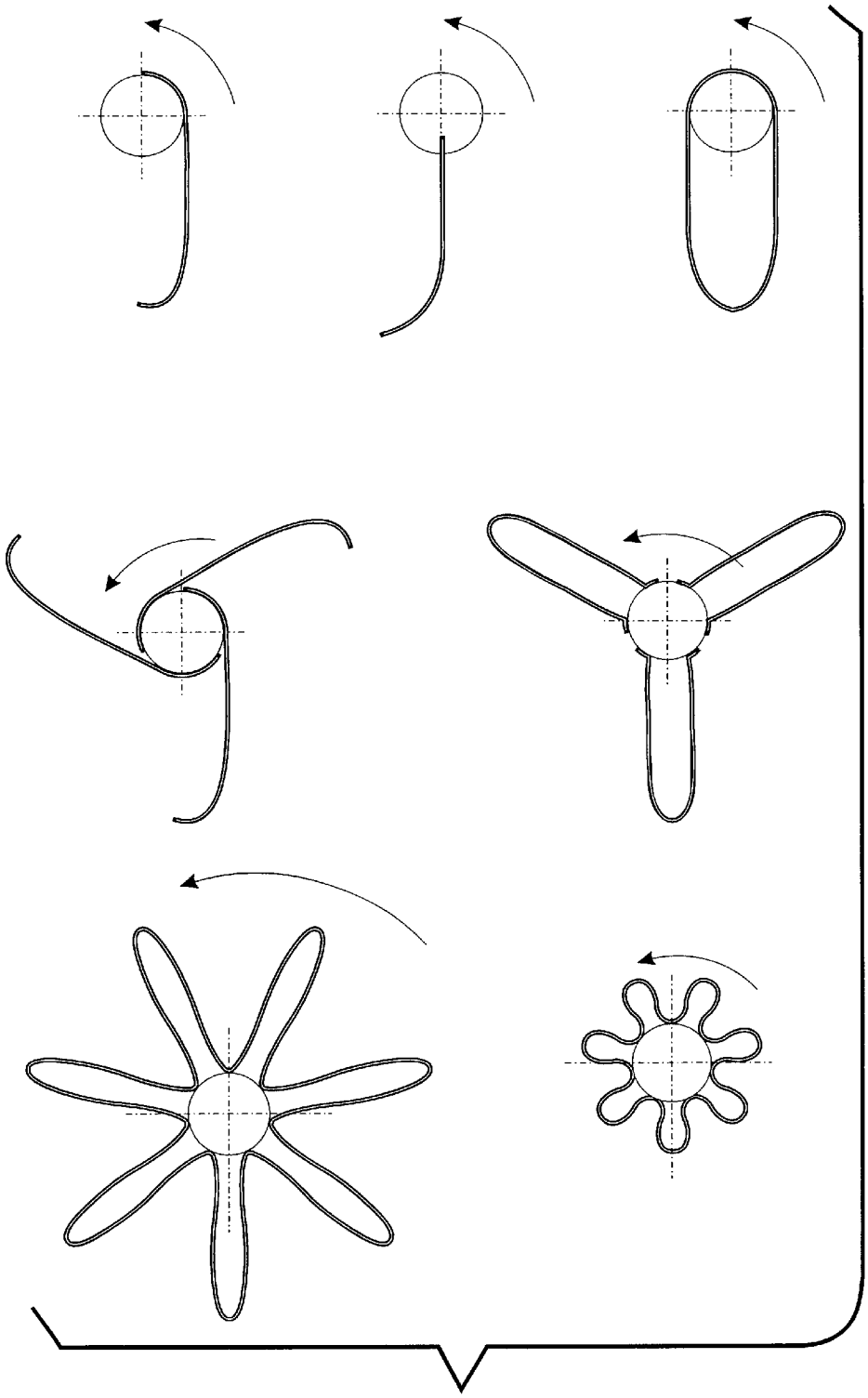
FIG. 5 illustrates cross-sectional views of exemplary agitator articles of the present invention.

FIG. 5 shows cross-sectional views of an array of alternative rod-sheet combinations and attachment schemes which produce suitable agitator articles of the present invention. It is readily appreciated that the rod-sheet combinations can include one or a plurality of open sheets, for example from 1 to about 20 sheets, and preferably from 1 to about 10 sheets, where the sheets are attached to the rod at only one end and the other end is unattached. Alternatively, a sheet can be attached to the rod at both ends or edges to form the aforementioned closed loop or endless surface structure. A plurality of sheets can be attached in closed loop fashion to provide a plurality of closed loops. In still yet another embodiment, a single sheet of sufficiently long width can be attached at both ends to form a loop structure and thereafter the looped sheet can be further attached to the rod at a plurality of intermediate points to form multiple closed loop structures which structures produce a plurality of lobe-like or finger-like protuberances when viewed in section and which structures afford high surface area and multiple surface contact points. Although not wanting to be limited by theory, it is believed that the flexible multi-sheet and flexible multi-loop embodiments of the agitator of the present provide superior and unexpected toner agitation, toner flow and toner leveling enhancement, and toner throughput enhancements compared to comparable developer housings which do not employ sheeted type agitators as in the present invention.

In embodiments the particulate material can be non-magnetic, magnetic, and mixtures thereof, such as a toner including a resin and a colorant, such as magnetite, and which toner particles have an average particle size of from about 2 to about 50 microns. The particulate material can also be a developer material including a mixture of magnetic or non-magnetic toner particles and magnetic or non-magnetic carrier particles.

The article, apparatus and methods of the present invention allow toners or developers to be transported, dispensed, and developed more accurately and more reliably than prior art development systems.

The invention will further be illustrated in the following non limiting Examples, it being understood that these Examples are intended to be illustrative only and that the invention is not intended to be limited to the materials, conditions, process parameters, and the like, recited herein. Parts to and percentages are by weight unless otherwise indicated.

COMPARATIVE EXAMPLE I

Toner Preparation and Evaluation

There was prepared a toner composition comprised of 57.3 percent by weight of a branched bisphenol A is fumarate, a polyester resin, where the estimated level of branched chains is between and 40 percent; 2 percent by weight of the polypropylene wax VISCOL 660P™, available from Sanyo Chemicals of Japan; 0.7% TRH charge control agent from Hodogaya of Japan; and 40% of MTH-009F magnetite from Tayca of Japan.

The toner mixture was extruded using a Werner & Pfleiderer ZSK-28 twin screw extruder at barrel set temperatures ranging from 90 to 120° C. at a throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified, and toner particles with a volume average diameter of about 4 to 9 microns as measured by a Coulter Counter were obtained. The toner product (3 lb. load) was then blended with small-sized external additives of 0.9 weight percent TS-720, a hydrophobic treated fumed silica obtained from Cabot Corporation at 2,740 rpm for about 2 minutes with an 80° F. jacket on a Henschel 10 L FM-10 blender.

Thereafter, the printing test was conducted in a continuous mode using Xerox Model 4520® printer and the average area coverage of the prints was about 6 percent. This printing apparatus included the developer housing substantially as shown in FIG. 1. About 2,000 print sheets were produced in each printing test. The print quality, such as solid area density and solid area uniformity, was measured by a reflective densitometer and a visual comparison chart during the printing. The solid area density was about 1.38, which is below the target of 1.40, and the solid area uniformity was about 11.9, which is much lower than the target of 15. There was obtained images having noticeable white banding defects which caused the uniformity reading to be below the target value. The printing test results including image density and image uniformity properties and charge properties of this and other examples are summarized in Table 1.

COMPARATIVE EXAMPLE II

The print test and evaluation described in Comparative Example I was repeated with the exception that the apparatus substantially as shown in FIG. 1 was used without the L-bracket. Thereafter, the printing test was conducted in a continuous mode using Xerox 4520® printer and the average area coverage of the prints was about 6 percent. About 2,000 print sheets were prepared in each printing test. The print quality, such as solid area density and solid area uniformity, was measured by a reflective densitometer and a visual comparison chart during the printing. The solid area density was about 1.36, which is below the target of 1.40, and the solid area uniformity was about 9.7, which is much lower than the target of 15. There were obtained images having noticeable white banding defects which caused the uniformity reading to be below the target value. The printing results are summarized in Table 1.

EXAMPLE I

Comparative Example I was repeated with the exception that the apparatus substantially as shown in FIG. 2 and incorporating the agitator disturber scraper article, substantially as shown in FIG. 3, was used for the print test. The rod was a made from 3/16 inch diameter aluminum bar stock. The length of the flexible sheet covered the entire the length of the rod. The width of the flexible sheet was about one-half inch( 0.5 inch) and the sheet thickness is about 150 microns. The sheet was made of MYLAR® polyester from DuPont Company. The speed ratio of the agitator to the donor roll is about 1.0. The apparatus operated continuously for about a 2-hour period producing about 2,000 prints, without any noticeable interruption in smooth flow and high throughput of toner materials. The solid area density was about 1.45, which was above the target value of 1.40, and the solid area uniformity was about 23.23, which was much higher than the target value of 15. There was obtained printed images that were free of white banding defects. No shutdown or clean-out step was needed during the period of operation. The printing results are summarized in Table 1.

EXAMPLE II

The print test in Example I was continued using the same developer unit and same agitator. One thousand additional prints were generated for a total of 3,000. The solid area density was about 1.47, which was above the target value of 1.40, and the solid area uniformity was about 24.28, which was much higher than the target value of 15. There was obtained printed images that were free of white banding defects. No shutdown or clean-out step was needed during the period of operation. The printing results are summarized in Table 1.

EXAMPLE III

Comparative Example I was repeated with the exception that the apparatus substantially as shown in FIG. 2 and incorporating the agitator of FIG. 3 was used. The dimensions of the agitator were the same as in Example II except that the sheet width of the flexible sheet was about three quarters of an inch(0.75 inch). The apparatus operated continuously for about 2,000 prints and without any noticeable interruption in smooth flow and high throughput of toner materials. The solid area density was about 1.44, which was above the target value of 1.40, and the solid area uniformity was about 19.1, which was much higher than the target value of 15. There was obtained printed images that were free of white banding defects. No shutdown or Sclean-out step was needed during the period of operation. The printing results are summarized in Table 1.

EXAMPLE IV

Comparative Example I was repeated with the exception that the apparatus substantially as shown in FIG. 2 and incorporating the agitator of FIG. 3 was used. The dimensions of the agitator were the same as in Example II except that the flexible sheet thickness was about 100 microns. The apparatus was operated continuously for about 2,000 prints and without any noticeable interruption in smooth flow and high throughput of toner materials. The solid area density was about 1.43, which was above the target value of 1.40, and the solid area uniformity was about 18.5, which was much higher than the target value of 15. There was obtained printed images that were again free of white banding defects. No shutdown or clean-out step was needed during the period of operation. The printing results are summarized in Table 1.

Other modifications of the present invention may occur to those skilled in the art based upon a review of the present application and these modifications, including equivalents thereof, are intended to be included within the scope of the present invention.

TABLE 1

Example Print Test Results

| Test Toner ID | Test conditions (print count) | Tribo charge ($\mu$C/g) | Solid Area Density | Solid Area Density uniformity |
|---|---|---|---|---|
| Comparative Example I | No agitator (2,000) | 7.8 | 1.38 | 11.9 |
| Comparative Example II | No agitator, no L-bracket, (2,000) | 8.2 | 1.36 | 9.7 |
| Example I | With agitator (2,000) | 11.2 | 1.45 | 23.23 |
| Example II | With agitator (3,000) | 10.9 | 1.47 | 24.28 |
| Example III | With agitator (2,000) | 12.0 | 1.44 | 19.1 |
| Example IV | With agitator (2,000) | 12.1 | 1.43 | 18.5 |

What is claimed is:

1. An agitator article comprising:

a rigid rod with a first end and a second end wherein the ends are adapted to engage a developer housing and a drive train for continuously rotating the rod; and at least one resilient flexible sheet attached to the rigid rod on at least one edge of the sheet, wherein the agitator article is adapted to be free of contact with the base portion of the developer housing, and which base portion supports a main stream of developer materials conveyed through the developer housing, when the agitator article is rotated within the developer housing.

2. An article in accordance with claim 1, wherein from about 1 to about 10 sheets are attached to the rod.

3. An article in accordance with claim 1, wherein the sheet is attached to the outer surface of the rod at from about 1 to about 90 degrees of rod circumference.

4. An article in accordance with claim 1, wherein the sheet is attached to the rod in at least one slotted vias in the surface of the rod.

5. An article in accordance with claim 1, wherein the rigid rod is constructed of cast metals, forged metals, powdered metals, molded metals, mixed metal alloys, resins, ceramers, ceramics, fiber composite, and mixtures and combinations thereof, and hollow tubular structures thereof.

6. An article in accordance with claim 1, wherein the sheet is constructed of polyesters, polyvinylacetate, polyethylene, polypropylene, styrene copolymers, fluoropolymers, two-ply structures thereof, multi-ply structures thereof, and mixtures thereof.

7. An article in accordance with claim 1, wherein the sheet has a width of from about 1 to about 30 millimeters, a length of from about 5 to about 50 centimeters, and a nominal thickness of from about 100 to about 1,000 microns.

8. An article in accordance with claim 1, wherein rotation of the article within the developer housing agitates and disturbs stagnated developer materials in the housing.

9. An article in accordance with claim 1, wherein rotation of the article within the developer housing agitates developer materials and smoothly urges the egress of developer materials through the developer housing.

10. An article in accordance with claim 1, wherein rotation of the rod and the attached flexible sheet within the developer housing causes developer to be knocked off or dislodged from a donor roll and a charge-metering blade situated in the developer housing and enables fresh developer to load onto the donor roll.

11. An agitator article comprising:

a rigid rod with a first end and a second end wherein the ends are adapted to engage a developer housing and a drive train for continuously rotating the rod; and at least one resilient flexible sheet attached to the rigid rod on at least edges of the sheet to form an endless flexible loop surface about the rod.

12. An apparatus comprising:

a housing adapted for the conveyance of particulate developer materials from a sump to an imaging member;

an auger within the housing adapted for advancing the developer materials from the sump to a donor roll;

the donor roll situated at least partially within the housing and adapted for advancing a charged and metered layer of the developer materials on the donor roll from the housing to the imaging member;

a charge metering blade contacting the surface of the donor roll adapted for charging and metering a thin layer of developer materials onto the donor roll; and an agitator article in accordance with claim 1, within the housing is adapted for further advancing developer materials from the auger to the donor roll and the charge metering blade.

13. An apparatus in accordance with claim 12, wherein the developer materials comprise magnetic or non-magnetic toner particles.

14. An apparatus in accordance with claim 12, wherein the relative rotational speed ratio of the agitator article to the donor roll is from about 0.2 to about 1.5.

15. An apparatus in accordance with claim 12, wherein the donor roll rotates at from about 30 millimeters per second to about 150 millimeters per second.

16. An apparatus in accordance with claim 12, wherein the throughput of developer materials from the sump to the donor roll is from about 50 to about 2,000 milligrams per minute.

17. An apparatus in accordance with claim 12, wherein the charge metering blade and the donor roll are biased.

18. An apparatus in accordance with claim 12, wherein rotation of the agitator article within the housing causes the agitator article to repeatedly contact portions of the surface of the donor roll and the charge metering blade componentry in the vicinity of the donor roll to disturb adherent developer materials and urge dislodged adherent developer materials into the main stream of the developer materials in the housing.

19. An imaging process comprising:

developing a latent image on a photoconductive surface with a toner material with the apparatus in accordance with claim 12;

transferring the resulting developed image from the photoconductive surface to an image receiver; and fixing the resulting transferred image to the image receiver to form printed images.

* * * * *